US007290640B2

(12) United States Patent
Korchagin et al.

(10) Patent No.: US 7,290,640 B2
(45) Date of Patent: Nov. 6, 2007

(54) HIGH-RISE, FIRE-FIGHTING, RESCUE AND CONSTRUCTION EQUIPMENT

(76) Inventors: Pavel V. Korchagin, Apt. 99, House 39, Dubninskaya Street, Moscow (RU) 127474; Marina E. Korchagina, Apt. 112, House 5, Second Khoroshevskiy Lane, Moscow (RU) 123007; Svetlana E. Tirskaya, Apt. 514, House 38, Michurinskiy Prospect, Moscow, Russia (RU) 119192; Vladimir A. Bararushkin, 2375 E. 16th St., 2nd Floor, Brooklyn, NY (US) 11235; Valeriy I. Nikitin, Apt. 14, House 20, Vatutinki - 1 Leninskiy Rayon, Moscow Region, Russia (RU) 142793

( * ) Notice: Subject to any disclaimer, the term of this patent is extended or adjusted under 35 U.S.C. 154(b) by 106 days.

(21) Appl. No.: 10/793,508

(22) Filed: Mar. 4, 2004

(65) Prior Publication Data

US 2005/0006178 A1 Jan. 13, 2005

Related U.S. Application Data

(63) Continuation-in-part of application No. 10/663,260, filed on Sep. 16, 2003, now Pat. No. 7,165,650, and a continuation-in-part of application No. 10/431,946, filed on May 8, 2003, now Pat. No. 7,204,344, and a continuation-in-part of application No. 10/334,023, filed on Dec. 30, 2002, now Pat. No. 7,036,630, and a continuation-in-part of application No. 10/205,981, filed on Jul. 26, 2002, now Pat. No. 7,096,996.

(51) Int. Cl.

| | |
|---|---|
| ***B66B 9/00*** | (2006.01) |
| ***E04G 3/00*** | (2006.01) |
| ***E06C 9/00*** | (2006.01) |

(52) U.S. Cl. ..... 187/239; 182/82; 182/87; 52/67

(58) Field of Classification Search ..... 187/239; 182/82, 87; 52/67

See application file for complete search history.

(56) References Cited

U.S. PATENT DOCUMENTS

| | | | | |
|---|---|---|---|---|
| 2,499,498 | A * | 3/1950 | Hammond, Jr. | 52/67 |
| 3,512,315 | A * | 5/1970 | Vitalini | 52/67 |
| 4,018,306 | A | 4/1977 | Lyons | 187/6 |
| 4,121,693 | A * | 10/1978 | Fry | 182/131 |
| 4,986,037 | A * | 1/1991 | Jackson, Jr. | 52/67 |
| 5,927,432 | A * | 7/1999 | Hershtik | 182/82 |

(Continued)

*Primary Examiner*—Patrick Mackey
*Assistant Examiner*—Eric E. Pico
(74) *Attorney, Agent, or Firm*—Steven E. Kahm; Nikolai & Mersereau, P.A.

(57) ABSTRACT

A functional compartment is provided in a building, a sliding frame is mounted in this compartment, connected with jack mechanisms; with the help of these mechanisms the sliding frame can slide beyond the outer limits of the building and back. Smooth and safe sliding of the frame is ensured by its supporting wheels sliding in guiding rails mounted in the surfaces of the functional compartment. The sliding frame is equipped in its front part, with a receiving panel with the right and left "pocket" guiders on it. The attachable section of the H-shaped rail is equipped with a mounting panel, with the similar square structure as of the receiving panel. The thickness of the mounting panel is less than a clearance between the "pocket" guiders and the outer surface of the receiving panel. The receiving panel is supplied with beveled guiding sides, and the mounting panel—with lower rounded corners.

3 Claims, 11 Drawing Sheets

U.S. PATENT DOCUMENTS 6,658,798 B1 * 12/2003 Frerichs et al. ..... 52/67
6,708,454 B1 * 3/2004 Frerichs et al. ..... 52/67
6,874,283 B1 * 4/2005 Hindle ..... 52/67
7,070,020 B2 * 7/2006 Preston ..... 182/82

* cited by examiner

HIGH-RISE, FIRE-FIGHTING, RESCUE AND CONSTRUCTION EQUIPMENT

This application is a continuation-in-part of Ser. No. 10/663,260 filed on Sep. 16, 2003, now U.S. Pat. No. 7,165,650 which is a continuation-in-part of Ser. No. 10/431,946 filed on May 8, 2003, now U.S. Pat. No. 7,204,344 which is a continuation-in-part of Ser. No. 10/334,023 filed on Dec. 30, 2002, now U.S. Pat. No. 7,036,630 which is a continuation-in-part of Ser. No. 10/205,981 filed on Jul. 26, 2002 now U.S. Pat. No. 7,096,996.

BACKGROUND OF THE INVENTION

1. Field of the Invention

This invention relates to elevating facilities for high-rise buildings and, specifically—to combinations of elevator & crane systems running on a rail attached to the outside of a building. The facilities may have an elevator portion—for traveling vertically up and down, and a crane portion—to extend a telescopic arm to a desired location and to support a passenger cabin for rescue operations.

The crane portion can also have a fire-fighting equipment—to access all parts of a building. The invention can be used for fire-fighting & rescue of people and equipment, and can also be used for construction, repairs and maintenance of high-rise structures.

2. Description of the Related Art

Currently, the prototype application for the USA patent "High-Rise Fire-Fighting, Rescue and Construction Equipment" (Ser. No. 10/663,260, filing date—Sep. 16, 2003, comprises a device having an elevator portion—for traveling vertically up and down outside of a building, and a crane portion—to extend an arm (telescopic) to a desired location. The telescopic arm consists of two parts, which are interconnected with the help of a pivoting mechanism. The telescopic arm has a pivot at its end, attached to a cramp, with the help of a vertical rotating mechanism. The cramp, also, is pivoted, with the help of vertical rotating mechanisms, to an outside platform supplied with a barrier; a cabin is hanged onto the platform. The cabin itself can rotate 360 degrees around its vertical axis—with the help of a rotating mechanism. The cabin has a passenger compartment inside, with sliding doors—to ensure safe work of personnel and for evacuation of people.

An outside platform supplied with a barrier has a fire-fighting equipment—to access all parts of a building. The crane portion can also haul building materials to any part of a building under construction and can be used for window washing (hand-washing) or other maintenance activity on the building.

The elevator portion has a passenger compartment with sliding doors—for connection with the cabin; and a vertical aperture with a staircase—for connection with a rescue elevator. The elevator portion, with its wheels and driving cog-wheels, has connection with the attachable section of an H-shaped rail. The attachable section can be mounted on a building wall, with consequent connection to a permanently mounted on this wall H-shaped rail.

The prototype structure doesn't allow a completely mechanized installment of the attachable section of the H-shaped rail—to a building wall; and, to make a completely mechanized washing of building walls and windows (with the help of a cabin).

SUMMARY OF THE INVENTION

The invention utilizes a functional compartment of a building—wherein a sliding frame is installed connected with jack mechanisms; with the help of these jack mechanisms, the sliding frame can slide beyond the outer limits of the building and back. Smooth and safe sliding of the frame are ensured by its supporting wheels which slide in guiding rails mounted in the surfaces of the functional compartment. The sliding frame is equipped, in its front part, with a receiving panel with the left and right "pocket" guiders mounted on it.

To ensure possible connection with the receiving panel, the attachable section of the H-shaped rail is equipped with a mounting panel, with the similar square structure as of the receiving panel; the thickness of the mounting panel is less than a clearance between the pocket guiders and the outer surface of the receiving panel—which helps to their connection.

For safety purposes, the receiving panel is supplied with beveled guiding sides, and the mounting panel—with lower rounded corners; the lower part of the functional compartment has a concrete basis—for safe mounting—remounting operations; the auxiliary portion has a movable ladder—for safe transportation of people from the passenger compartment to the auxiliary portion.

To allow a completely mechanized washing of building walls and windows, with the help of a cabin, the back surface of the cabin is equipped with an attachable frame supplied with round mechanical brushes and a profile with holes for fluid sprayers and air routes. To ensure a possibility of mounting-demounting operations of the attachable frame, this frame is equipped with fixing handles.

OBJECTS OF THE INVENTION

It is an object of the invention to provide a functional compartment in a building; in this compartment a sliding frame is mounted, connected with jack mechanisms, which help the sliding frame move beyond the outer limits of a building and back. Safe and smooth sliding of the frame are ensured by supporting wheels inter-connected with guiders in the surfaces of the functional compartment.

It is an object of the invention to provide a receiving panel in the front part of the functional compartment, with "pocket" guiders on the right and left sides of the panel.

It is an object of the invention to provide connection of the attachable section of the H-shaped rail with the receiving panel; the attachable section of the H-shaped rail is equipped with a mounting panel of the same square configuration as of the receiving panel; the thickness of the mounting panel is less than a clearance between mounted "pocket" guiders and outer surface of the receiving panel—to ensure their connection.

It is an object of the invention to provide the receiving panel with beveled guiding sides, and the mounting panel—with lower rounded corners—for safe connection.

It is an object of the invention to provide a concrete basis in the lower part of the functional compartment—for safe mounting-demounting of the attachable section of the H-shaped rail.

It is an object of the invention to supply the auxiliary portion with a movable ladder—for safe transportation of people from the passenger section to the auxiliary portion.

It is an object of the invention to provide, on the back surface of the cabin, an attachable frame with round mechanical brushes and a profile with holes for fluid sprayers and air routes—for a possibility of a completely mechanized washing of building walls and windows.

It is an object of the invention to supply the attachable frame with fixing handles—to ensure possible mounting-demounting of the attachable frame on the back surface of the cabin.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
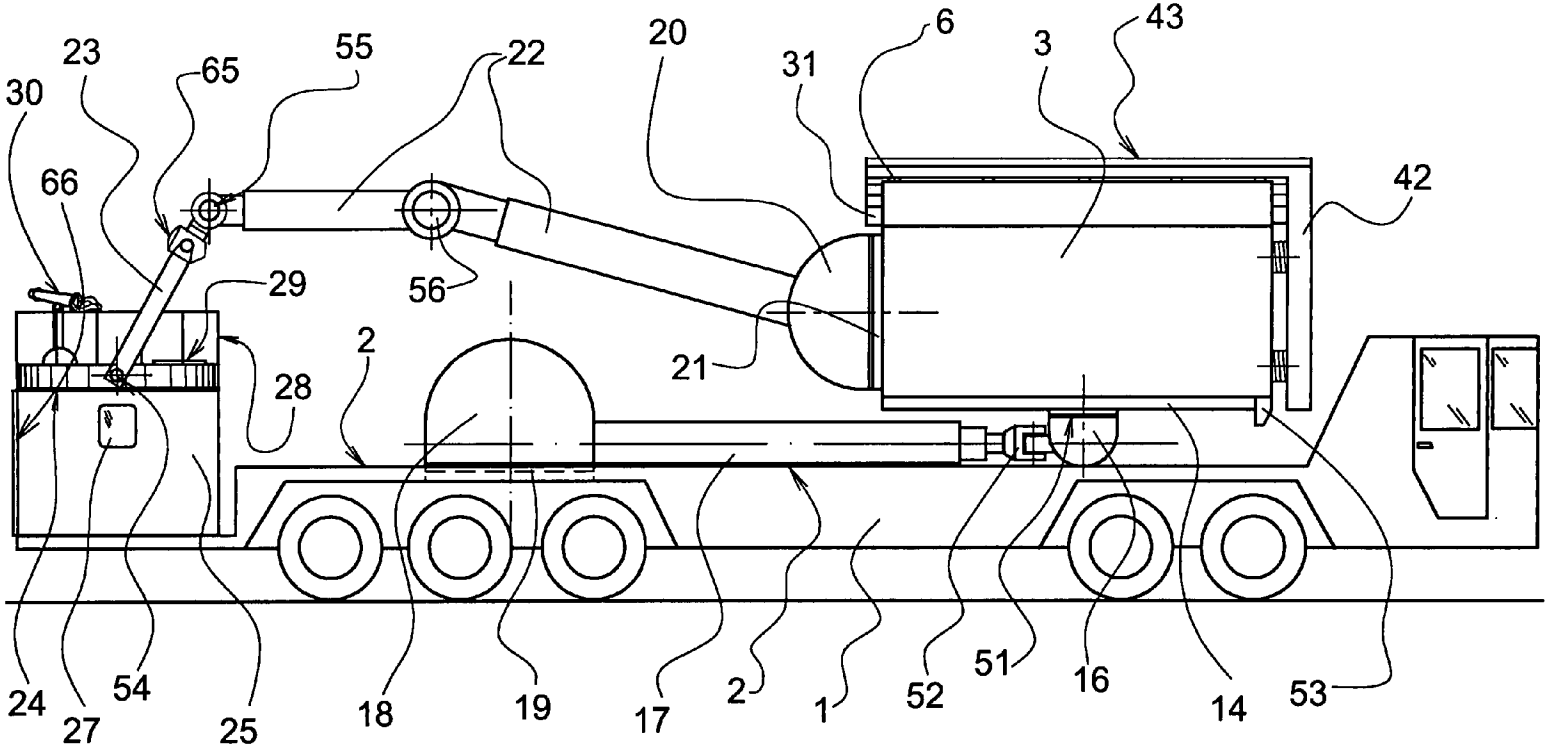
FIG. 1 shows a side view of the invention on a vehicle.

As it was explained and described in the previous application for the USA patent "High-Rise Fire-Fighting, Rescue and Construction Equipment" (Ser. No. 10/663,260, filing date—Sep. 16, 2003) now U.S. Pat. No. 7,036,630 issued May 2, 2006, the invention contained a device 30 and an elevator portion 31—for traveling vertically up and down on the outside of a building, and a crane portion—for extending an arm (telescopic) to a desired location on the building. The telescopic arm consists of two parts which are interconnected with the help of a pivoting mechanism. The telescopic arm has a pivot at its end attached to a cramp, with the help of a vertical rotating mechanism. The cramp, also, is pivoted, with the help of vertical rotating mechanisms, to an outside platform supplied with a barrier; a cabin is hanged onto the platform. The cabin itself can rotate 360 degrees around its vertical axis—with the help of a rotating mechanism. The cabin has inside a passenger compartment, with sliding doors—to ensure personnel's work and evacuation of people.

An outside platform, supplied with a barrier, has a fire-fighting equipment—to access all parts of a building. The crane portion can also haul building materials to any part of a building under construction and can be used for walls & window washing (hand) or other maintenance activities on the building.

The elevator portion 3, with its supporting wheels 6 and the driving cog-wheels 8 has connection with the attachable section 31 of the H-shaped rail.

The attachable section 31 of the H-shaped rail can be mounted onto a building wall 5 with consequent connection to a permanently installed H-shaped rail 4—on this wall.

Figure 2:
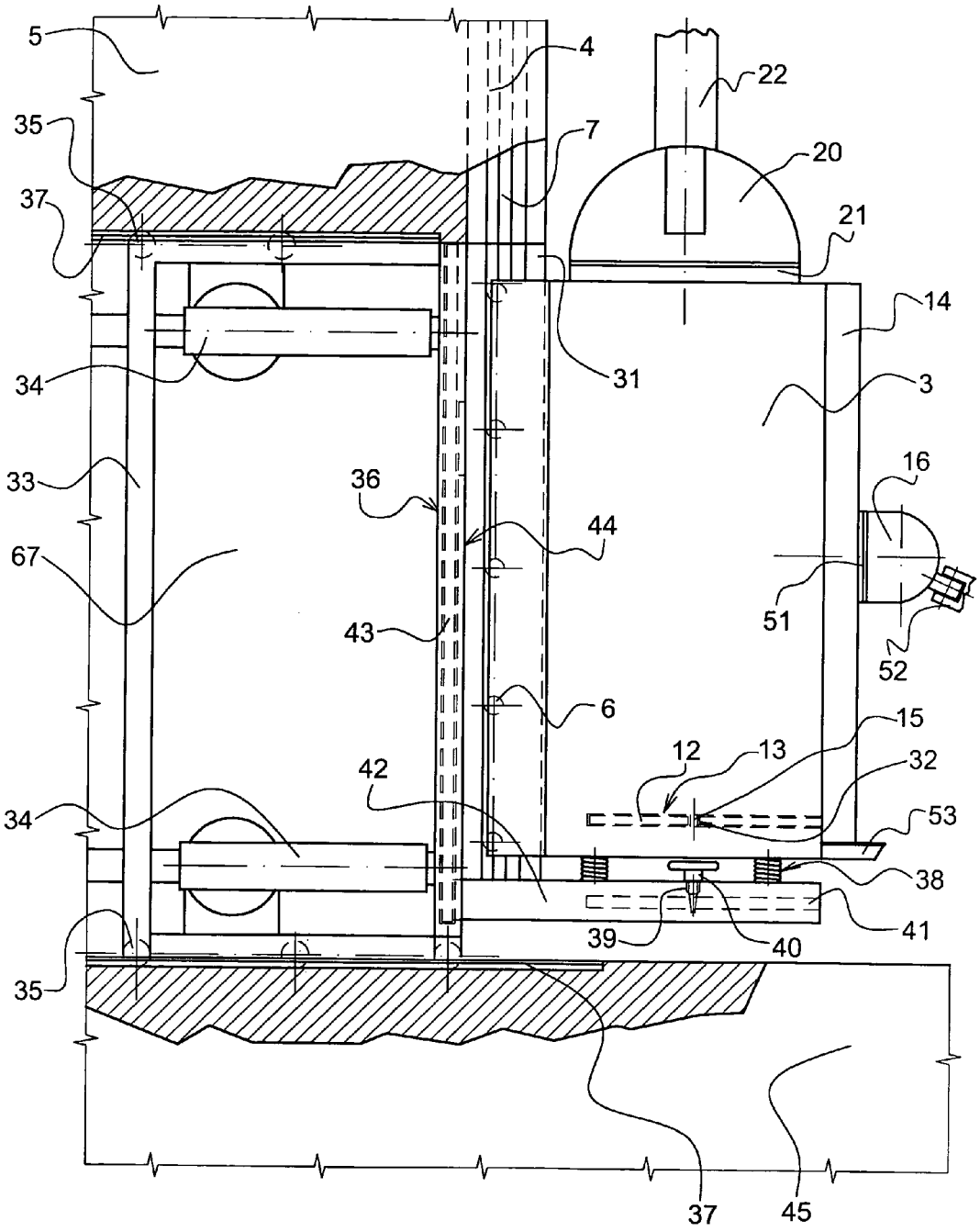
FIG. 2 shows a side view of the invention to a functional compartment of a building with a moved-in sliding frame.
Figure 3:
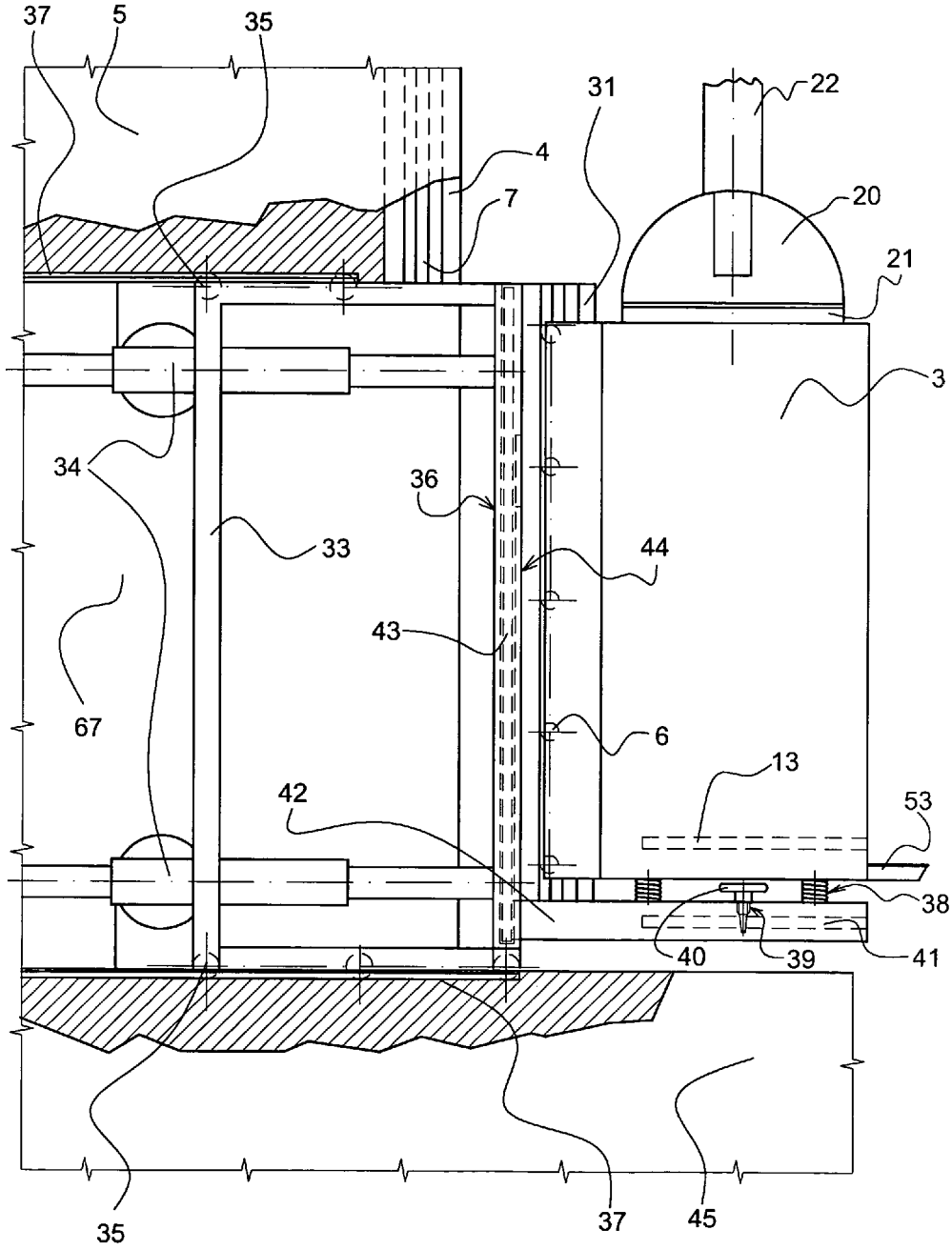
FIG. 3 shows a side view to the functional compartment of the building with a moved-out sliding frame.
Figure 9:
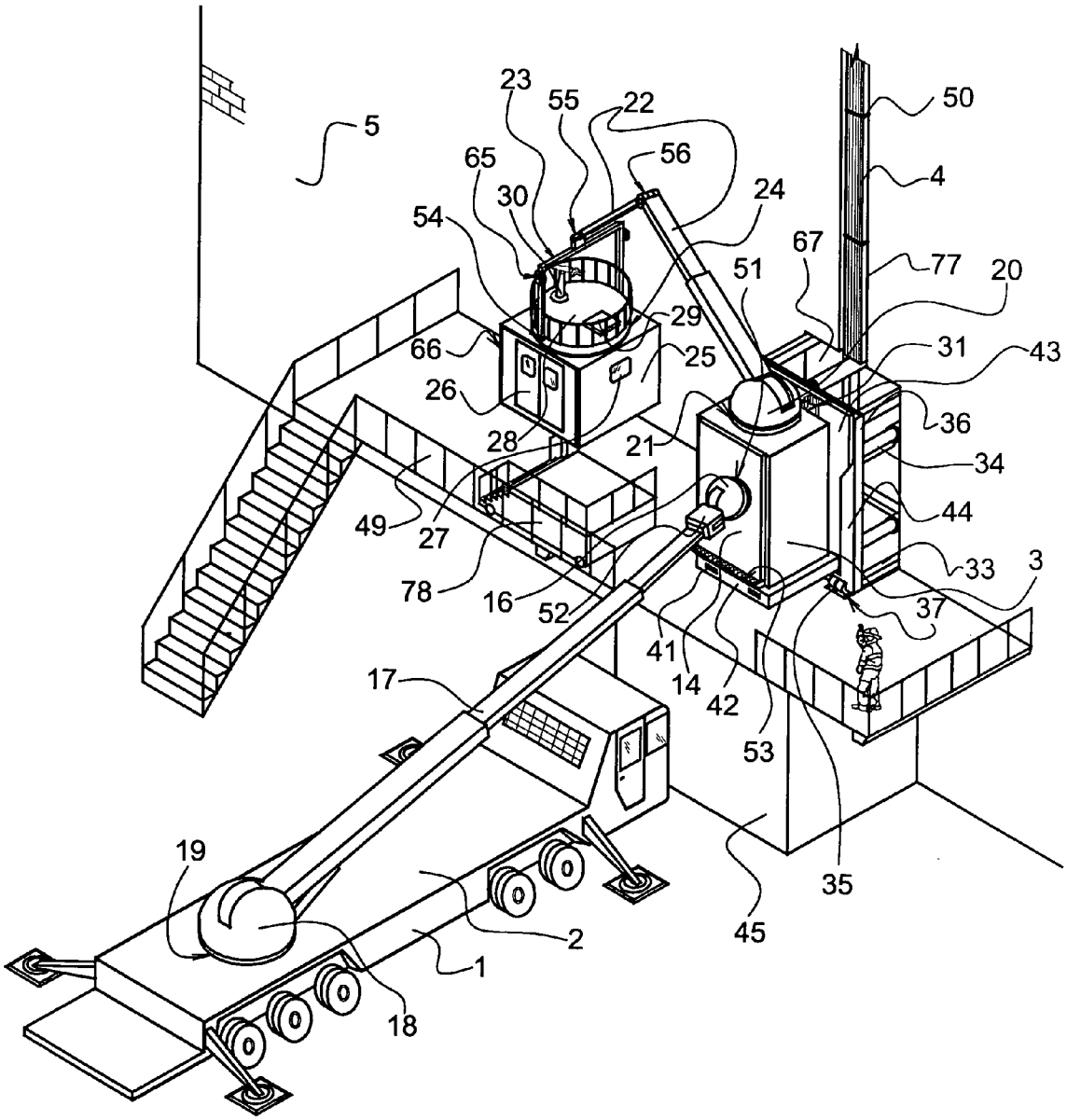
FIG. 9 shows a perspective view of the elevator portion being installed onto an H-shaped rail.

As shown in FIGS. 2, 3 and 9, the invention provides a functional compartment 67 (in a building 5) wherein a sliding frame 33 is installed, connected with the jack mechanisms 34. The sliding frame 33, with the help of these jack mechanisms 34, can slide out beyond the building limits and back. Smooth and safe sliding of the frame 33 are ensured by its supporting wheels 35 which slide in the guiders 37 mounted on the surfaces of the functional compartment 67. The sliding compartment, in its front part, is supplied with a receiving panel 36 with mounted "pocket" guiders 44 mounted on the left and right sides of the receiving panel 36.

As shown in FIGS. 2, 3, 4 and 9, the attachable section 31 of the H-shaped rail is supplied with a mounting panel 43—to ensure a possibility of connection with the receiving panel 36, with the similar square structure as of the receiving panel 36. The thickness of the mounting panel 43 is a little less than the clearance between the mounted "pocket" guiders and outer surface of the receiving panel 36—which helps to make their connection.

Figure 4:
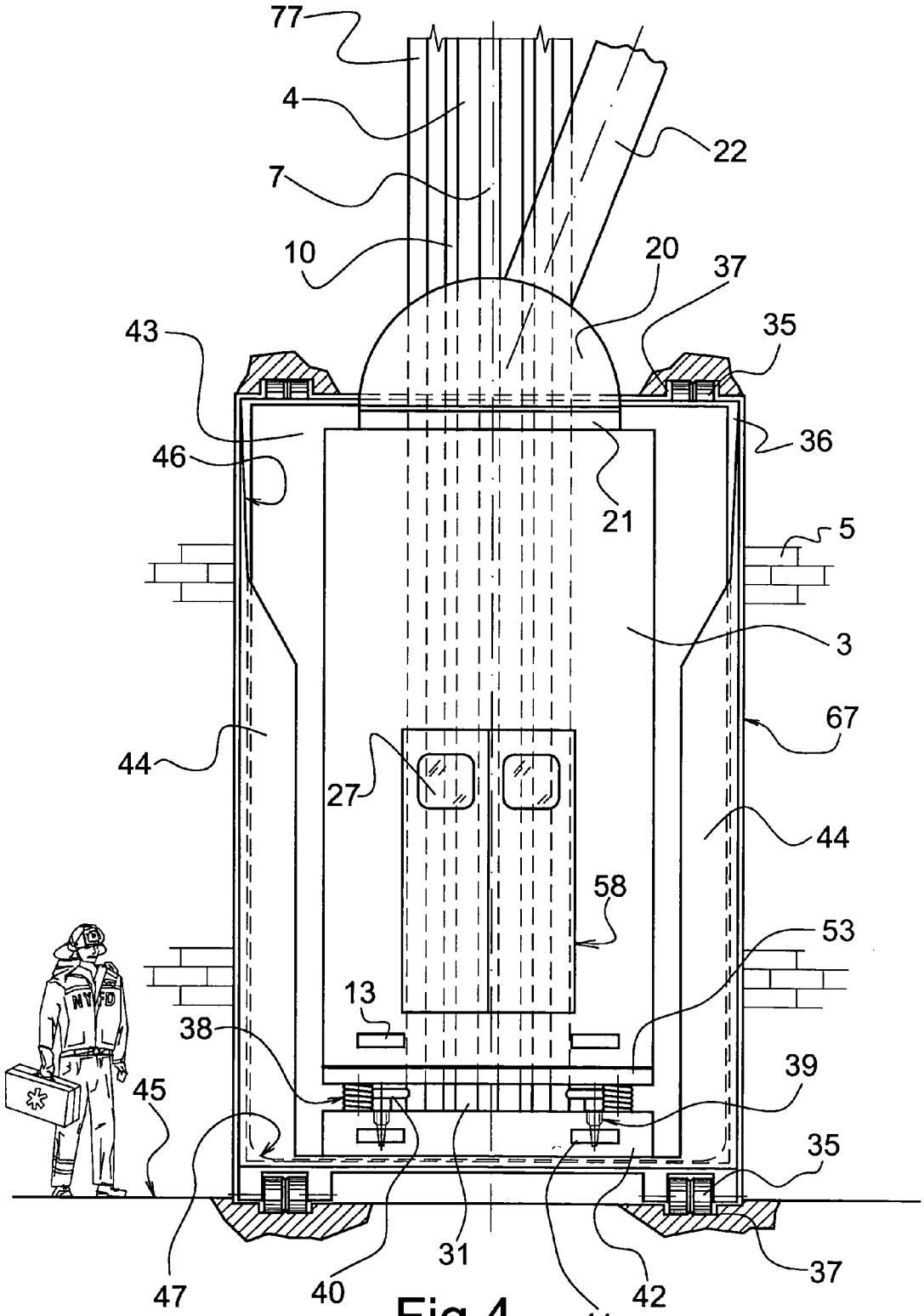
FIG. 4 shows a front view of the attachable section of an H-shaped rail at the moment of its connection with a permanently installed H-shaped rail.

As shown in FIG. 4, the receiving panel 36 is supplied with beveled guiding sides 46, and the mounting panel 43—with lower rounded corners 47—to ensure safe connection.

As shown in FIGS. 2, 3, 9 and 10, the lower part of the functional compartment 67 of the building 5 is provided with a concrete basis 45—for safe mounting—remounting of the attachable section 31 of the H-shaped rail.

Figure 10:
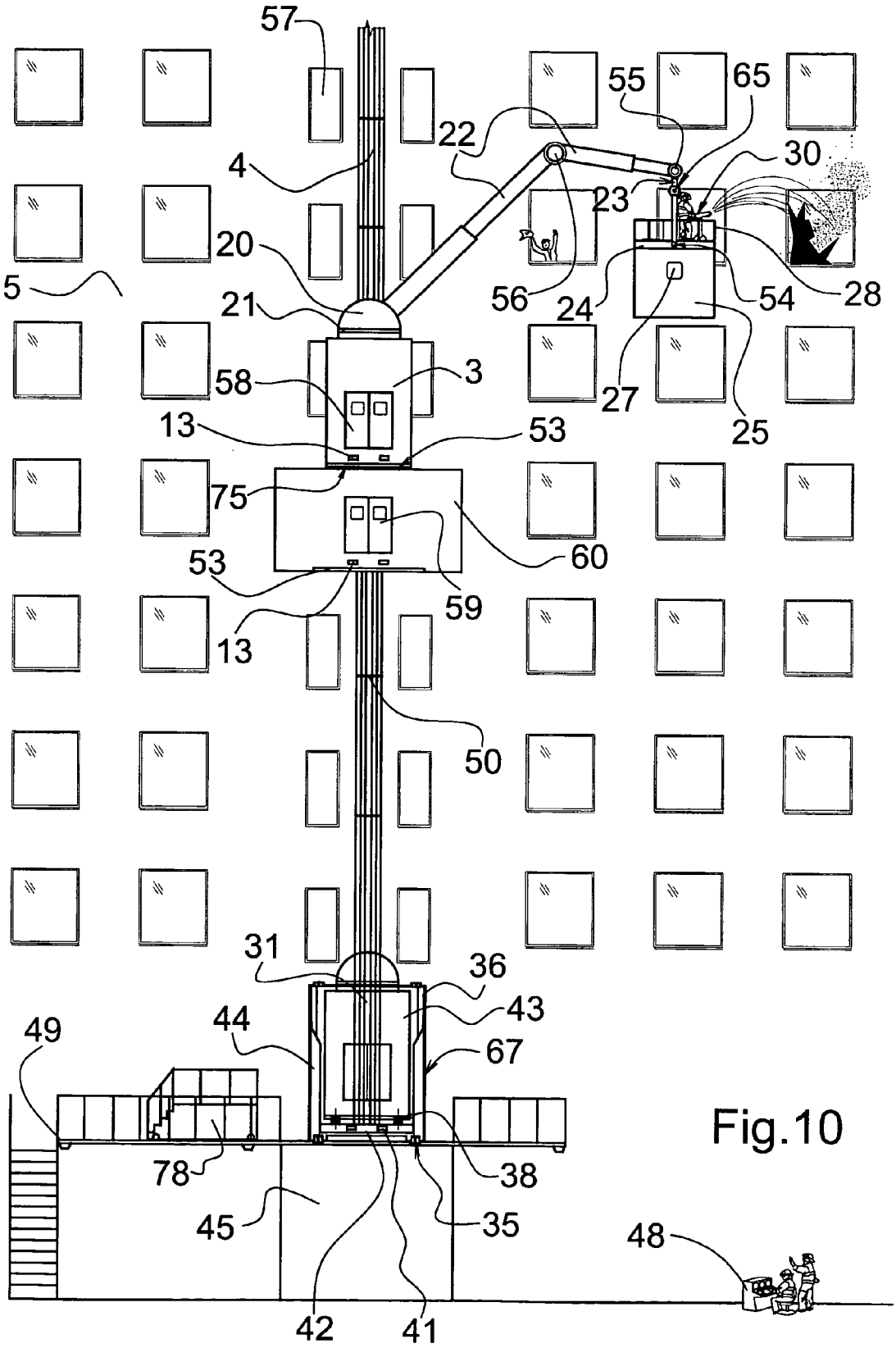
FIG. 10 shows a front view of a building having the elevator and crane system used for fire-fighting and rescue.

As shown in FIGS. 9 and 10, the auxiliary portion 49 is supplied with a portable ladder 78—for safe transportation of people from the passenger compartment 68 of the elevator portion 3 to the auxiliary portion 49 and back.

Figure 11:
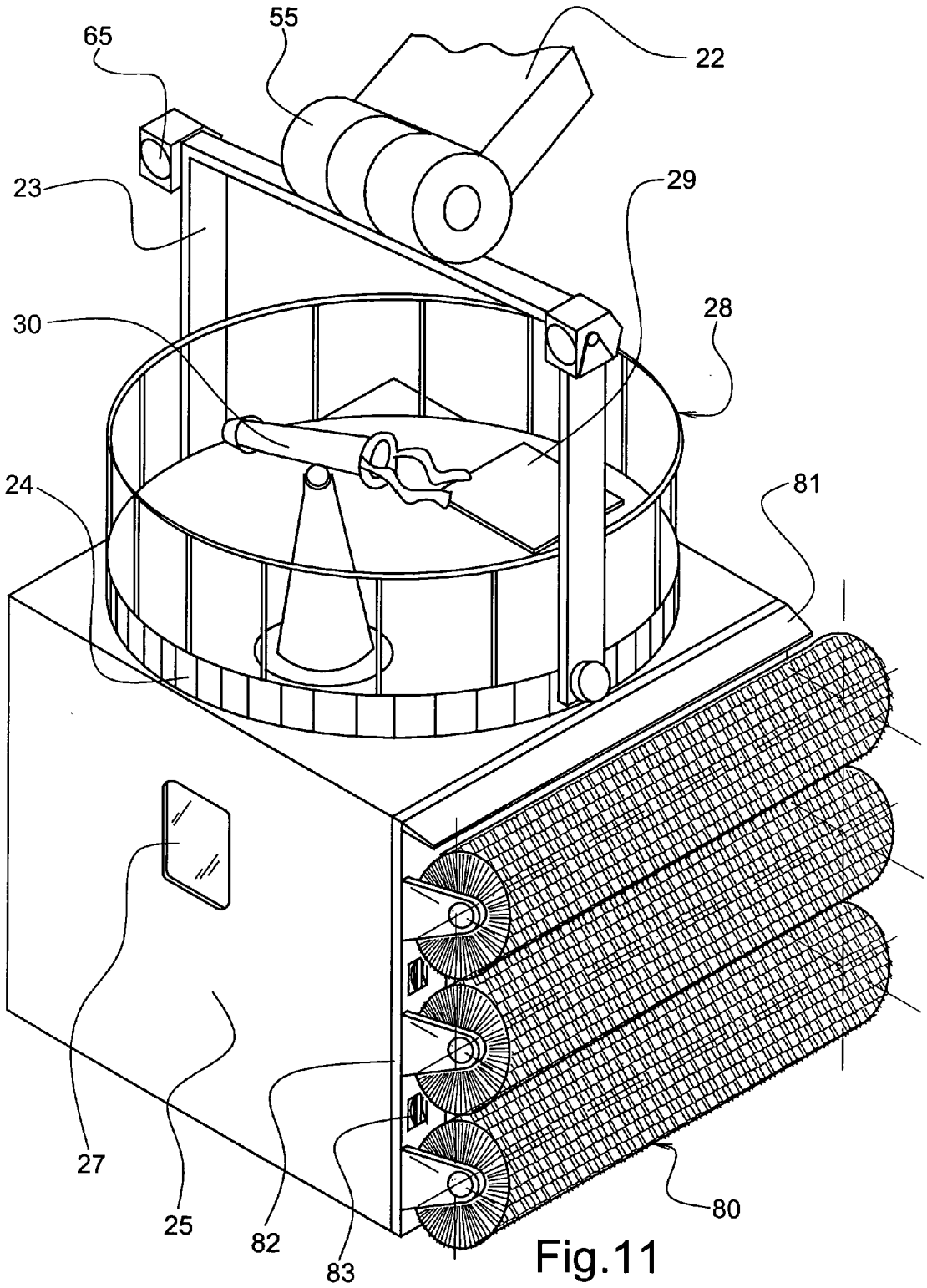
FIG. 11 shows a perspective view of the cabin with the installed equipment for mechanized washing of building walls and windows.

As shown in FIG. 11, the back surface of the cabin 25 is supplied with attachable frame 82 with round mechanical brushes 80 and a profile 81 with holes for fluid sprayers and air routes—for a possibility of a completely mechanized washing, with the help of the cabin 25, of building walls and windows.

As shown in FIG. 11, the attachable frame 82 is supplied with fixing handles 83—to ensure possibility of mounting-demounting of the attachable surface of the cabin 25.

The elevator portion 3 with the attachable section 31 of an H-shaped rail, as well as the whole attachable structure with the telescopic arm 22 and the cabin 25, is mounted on the chassis 1, as shown in the FIG. 1. In case the elevator portion isn't at work, it is to be kept in such position in a special hangar (fire depot). When the depot gets a fire alarm, the chassis 1 being kept on the top surface 2 together with the elevator portion 3, is delivered to the building on fire immediately.

As shown in the FIG. 9, when the chassis 1 is delivered to the building on fire 5, 15 the chassis 1 is placed close to a n H-shaped rail permanently located on the building, and the auxiliary portion 49 of the building. After that, the process of installment of the elevator portion 3 and of the attachable section 31 of an H-shaped rail to a building wall starts , as it is shown in FIGS. 2, 3, 4 and 9.

The installment of the elevator portion 3 and of the attachable section 31 of an H-shaped rail to the building wall is as follows:

With the help of a vertical pivoting mechanism 18, the telescopic rotating pole 17 is lifted to a level approximately 45 degrees in relation to the top working surface 2 of the car chassis 1. At the moment, a holding bed mechanism 14, due to its vertical pivoting mechanism 16, is kept strictly horizontal.

Then, with the help of a horizontal rotating mechanism 19, the telescopic rotating pole 17 with the holding bed mechanism 14 on which the elevator portion 3 with the attachable section 31, is turned towards the building 5.

After that, the holding bed mechanism 14, with the help of its vertical pivoting mechanism 16, is rotated 90 degrees to a strictly vertical position.

At the same time, with the help of the pivoting mechanism 20 and of a horizontal rotating mechanism 21, the first part of the telescopic arm 22 is lowered towards the building 5—approximately 45 degrees in relation with the vertical axis of the elevator portion 3. With the help of the pivoting mechanism 56, the second part of the telescopic arm is lowered approximately 90 degrees in relation with the first part of the telescopic arm 22. With that, the cramp 23, with the help of the vertical rotating mechanism 55, is placed into a strictly vertical position. At the same time with the cramp 23, the cabin 25 is aligned into a strictly vertical and horizontal position by the vertical rotating mechanisms 54 and a horizontal rotating mechanism 24.

At the same time with that, the jack mechanisms 34 are put into action, which move out the sliding frame 33—from the functional compartment 67 of the building 5.

As a result of this movement, the receiving panel 36, mounted on the outer end of the sliding frame 33, gets moved out onto the concrete basis 45 (approximately 1.5 meters).

Such smooth and safe movement of the sliding frame 33 is ensured by its supporting 7 wheels sliding in the guiders 37 mounted on the surfaces of the functional compartment 67.

Then, the telescopic rotating pole 17 is moved towards the building wall 5 in such way that the lower part of the outer surface of the mounting panel 43 touches the upper part of the outer surface of the receiving panel 36.

After that, with the help of the rotating mechanisms 16, 51 and 52, the holding bed mechanism 14 is aligned until the mounting panel is installed strictly parallel, with all its surfaces, in relation with the receiving panel 36.

Then, with the help of the vertical pivoting mechanism 18, the telescopic rotating pole is lowered down. As a result of this movement, the mounting panel 43 starts moving into the "pocket" guiders 44 of the receiving panel 36.

At that, this safe and smooth connection and installation will be ensured by beveled guiding sides 46 of the receiving panel 36 and by lower rounded corners 47 of the mounting panel 43.

After the mounting panel 43 is completely installed (lowered) into the pocket guiders 44 of the receiving panel 36, the upper beveled surface of the attachable section 31 of an H-shaped rail will be located a few millimeters lower than the lower beveled surface of an H-shaped rail, and the vertical axis of both rails 31 and 4 will be strictly parallel.

As the elevator portion 3 and the telescopic arm 22, and the cabin 25 are installed on the attachable section 31 of an H-shaped rail , then, after the above-described installation it is possible to remount the elevator portion 3 from the holding bed mechanism 14. For this purpose, the holes 32 of the fork elements 12 are disconnected from jack latches 15 of the elevator portion 3.

Then, by moving the telescopic rotating pole 17, the slots 13 located in the body of the elevator portion 3, are disconnected from fork elements 12 of the holding bed 33 mechanism 14.

The loading-unloading holding bed 14, freed after this operation, is rolled up and placed into a transport position on the top surface 2 of the chassis 1. (The demounting operation of the elevator portion 3 and of the attachable section 31 is made by a vice versa action).

Simultaneously with that, the jack mechanisms 34 are put into action, which move the sliding frame 33 into the functional compartment 67 of the building 5.

As a result of this movement, the receiving panel 36 mounted on the outer end of the 4 sliding frame 33, and, also the attachable section 31 of an H-shaped rail with the elevator portion 3 mounted on it, are moved towards the building wall 5.

After this operation is completed, the upper beveled surface of the attachable section 7 31 of the H-shaped rail gets located (within a few millimeters) under the lower beveled surface of the H-shaped rail, and their vertical axis are coincided—as shown in FIGS. 2 and 4.

As a result, the attachable section 31 of the H-shaped rail and the permanently mounted on the building H-shaped rail 4 get formed a unified line of an H-shaped rail 12 on the building wall 5.

Drive structure 11 located in the body of the elevator portion 3, is activated, and, in its turn, puts into action the driving cog-wheels 8 which, interacting with the guiding racks 9 of the guiding slots 10, start moving the elevator portion 3 on the attachable section 31 of the H-shaped rail.

Simultaneously, the wheels 6 start moving in the guiding slots 7, securing a stable position of the elevator portion 3 on the H-shaped rail.

Thus, the elevator portion 3 travels from the attachable section 31 of the H-shaped rail to the permanently mounted (on the building 5) H-shaped rail 4, and it can now travel in both directions along the length of the H-shaped line to any high level of the building 5.

Correspondingly, it becomes possible to immediately move the elevator portion 3 to that dangerous floor level (on fire) of the building 5, and to start fire-fighting operations with the help of a fire/foam pipe 30 mounted on the outside surface 28, with the barrier of the cabin 25—as it is shown in FIG. 10.

Simultaneously with the lifting of the elevator portion 3 to a dangerous level/floor, mounting of an autonomous rescue elevator 60 starts. To ensure a possibility of such operation first, the disconnected attachable section 31 of an H-shaped rail is demounted. It is done in the following consequence:

The jack mechanisms 34 are activated, which move out the sliding frame 33 from the functional compartment 67 of the building 5. As a result of this movement, the receiving panel 36, mounted on the outer surface of the sliding frame 33, and also, the attachable section 31 of the H-shaped rail get moved out onto the concrete basis 45 (approximately, 1.5 meters).

With the help of the horizontal rotating mechanism 19 and the vertical pivoting mechanism 18, the telescopic rotating pole 17 is turned and lifted towards the building 5—to the location of the attachable section 31 of the H-shaped rail. Then, with the help of the rotating mechanisms 16, 51 and 52, the holding bed mechanism 14 is aligned in such way that its fork elements 12 get located opposite the slots 41 of the tray 42 of the attachable section 31 of the H-shaped rail.

Simultaneously with that, the screw fixing mechanisms 40 are screwed out of the screw holes 39 of the tray 42, preparing, by this, the slots 41 to locate in them the fork elements 12 of the holding bed mechanism 14.

Then, the telescopic rotating pole 17 is moved out—until the fork elements 12 of the holding bed mechanism 14 are completely moved into the slots 41.

Next, the screw fixing mechanisms 40 are screwed back into the screw holes 39 of the tray 42,—fixing, by this, the attachable section 31 of the H-shaped rail on the holding bed mechanism 14.

After that, the telescopic rotating pole 17 is lifted—until the mounting panel 43 of the attachable section 31 of the H-shaped rail gets moved out from the pocket guiders 44 of the receiving panel 36.

Then, with the help of the telescopic rotating pole 17, the above attachable section 31 of the H-shaped rail is transported to the spare parking space near the building 5, close to the auxiliary portion 49, and is unloaded there.

Now, when the receiving panel 36 is free, it's possible to start mounting of an autonomous rescue elevator 60.

For this purpose, the chassis 1 travels from the auxiliary part of the building 49; when the chassis 1 delivers the elevator portion 3 to the building 5, it makes the surface vacant for another chassis 1 with the autonomous rescue elevator 60.

After the parking of the chassis 1 with the autonomous rescue elevator 60 is completed (on the vacant surface at the auxiliary part of the building 49), the rescue elevator is being mounted to the building 5.

The autonomous rescue elevator 60, like the elevator portion 3, has connection to the attachable section 31 of the H-shaped rail—through the elastic tire wheels 6 and the drive cog-wheels 8.

The chassis 1, to which the autonomous rescue elevator 60 was delivered (to the building 5), has the same loading-unloading mechanism, as on the previous chassis 1 with the elevator portion 3 delivered (with the rotating mechanisms 16, 18, 19, 51 and 52) and with the telescopic pole 17 and the holding bed mechanism 14.

In view of this, the sequence of mounting operations for the rescue elevator 60 to the building 5 (as well as the demounting ones) is the same as with the elevator portion 3.

After the autonomous rescue elevator 60 is installed on the H-shaped rail, it is being lifted, after the elevator portion, to the building level on fire.

While the elevator portion 3 is already on the required level, and it starts fire-fighting operations—with its own fire/foam pipe 30 installed on the outside surface 28, with the barrier.

Simultaneously with the fire-fighting operations, the cabin 25 of the elevator portion 3 can start evacuating people which can't use fire staircases and escape exits. For this purpose, the cabin 25 is transported to a window embrasure of the building 5 where the people are located.

Then, a safe junction of the cabin's 25 surface with the sliding doors to the window embrasure is made—with the help of an elastic profile element 66—along the perimeter of the sliding doors 26.

Next, the sliding doors 26 are opened, and the people escape from the dangerous building level—though the window embrasure to the cabin 25.

By that moment the autonomous rescue elevator 60 came up to the level of a dangerous floor and aligned with the lower surface of the elevator portion 3—with the help of its elastic profile element 75 mounted on the upper surface of the elevator.

The cabin 25 with evacuated people is transported to the outside surface of the autonomous rescue elevator 60, with sliding doors 59 supplied with fireproof glasses 27.

Figure 6:
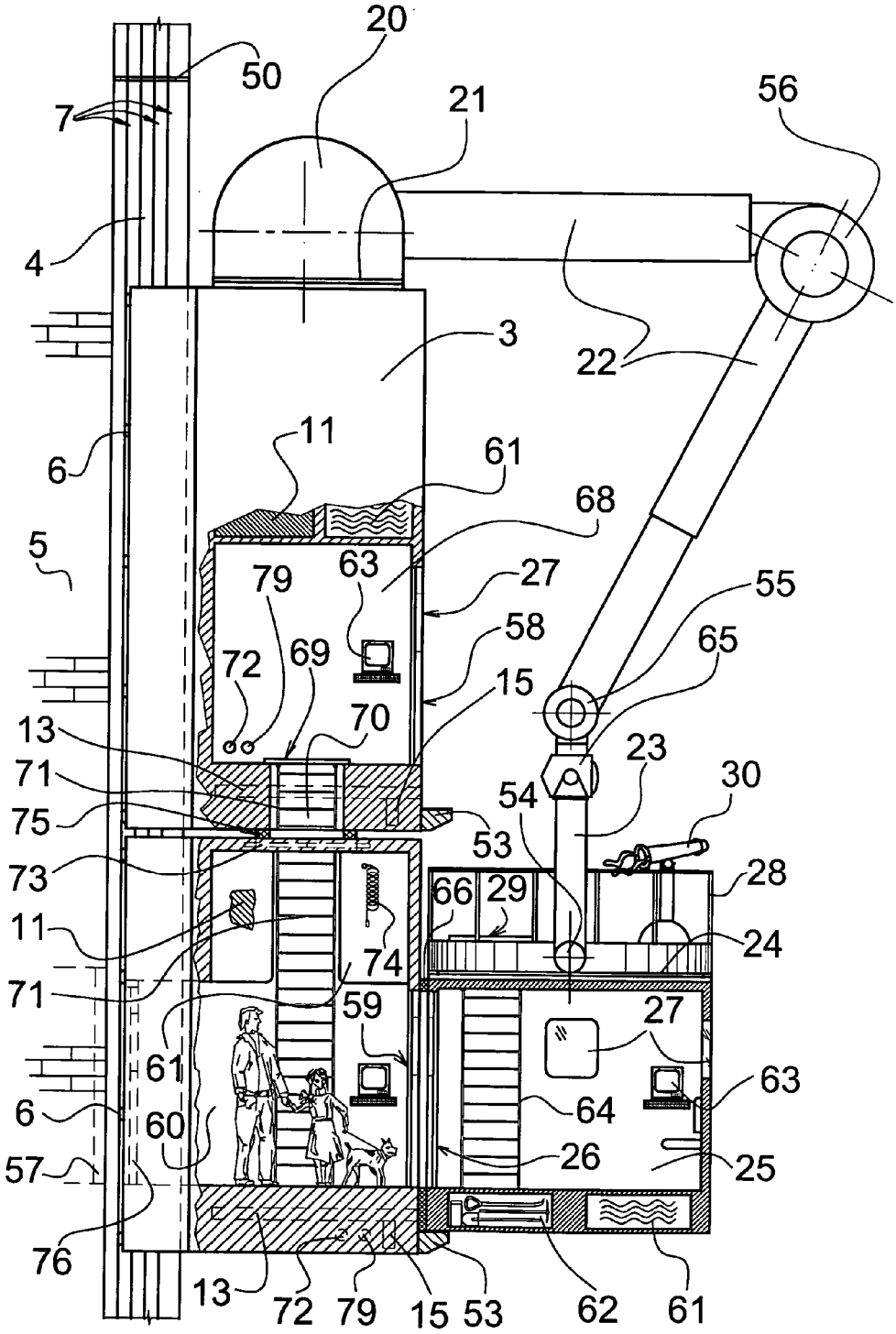
FIG. 6 shows a side view of the elevator portion being connected with the autonomous rescue elevator.
Figure 7:
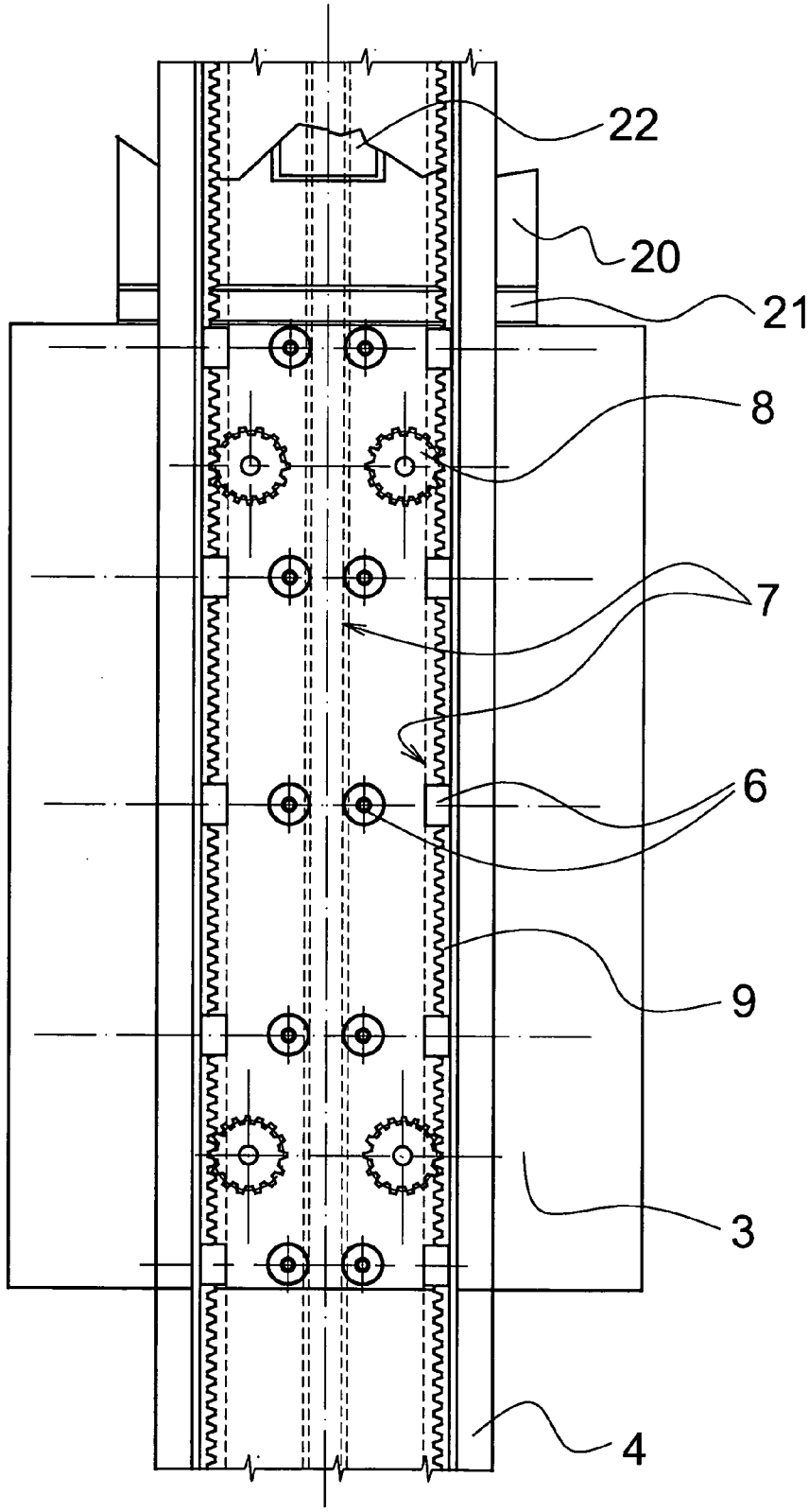
FIG. 7 shows a back view of the elevator portion installed onto an H-shaped rail.
Figure 8:
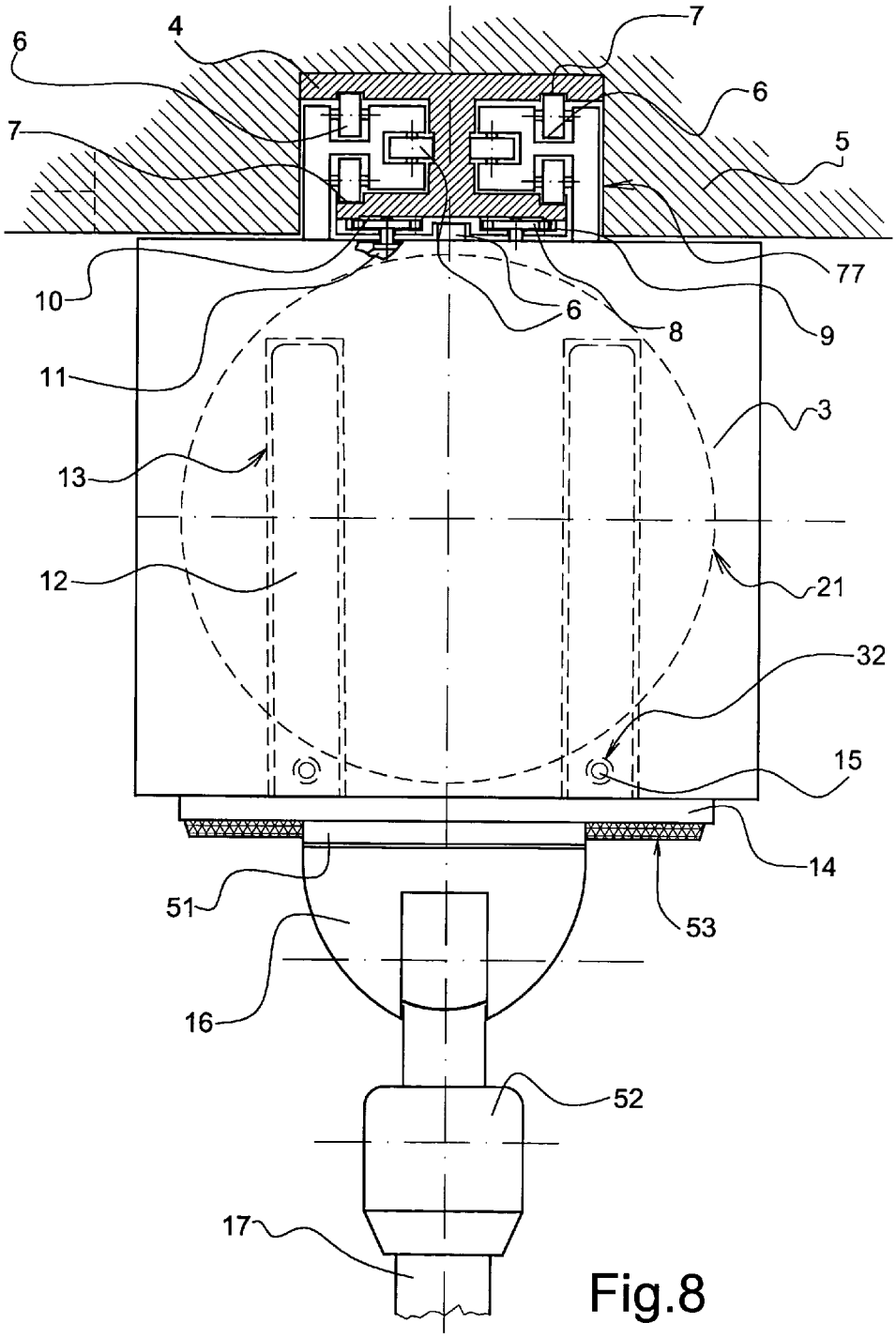
FIG. 8 shows a top view of the elevator portion installed onto an H-shaped rail.

Then, as it is shown in FIG. 6, the surface of the cabin 25 with the sliding doors 26 is aligned with the outside surface of the autonomous rescue elevator 60 with the sliding doors 59.

Close and safe fitting of the cabin 25 to the autonomous rescue elevator 60 is made with the help of the elastic profile element 66 along the outer perimeter of the sliding doors 26 of the cabin 25, and also, with the help of supporting elements with elastic gaskets 53 of the autonomous rescue elevator 60.

Next, the sliding doors 26 of the cabin 25 and the sliding doors 59 of the autonomous rescue elevator 60 are opened, and the evacuated people leave the cabin 25 for the autonomous rescue elevator 60.

Then, all these sliding doors are closed; the cabin 25 disconnects from the autonomous rescue elevator 60 and returns to the dangerous level of the building 5, and the autonomous rescue elevator 60 transports the people down—to the auxiliary part of the building 49.

Such operations are to be continued until all the people from the dangerous level are evacuated.

The present invention also allows a speedy evacuation of people from a dangerous level of the building. It is especially important when there are many people on the dangerous level or if that level is very high.

Such possibility is realized by:

Variant A a passenger compartment 68 of the elevator portion 3, which outside surface is supplied with sliding doors 58 equipped with fireproof glass windows 27.

Variant B emergency exits 57 of the building located on each floor of the building 5—symmetrical to the vertical axis of the sliding doors 76 of the autonomous rescue elevator 60.

Figure 5:
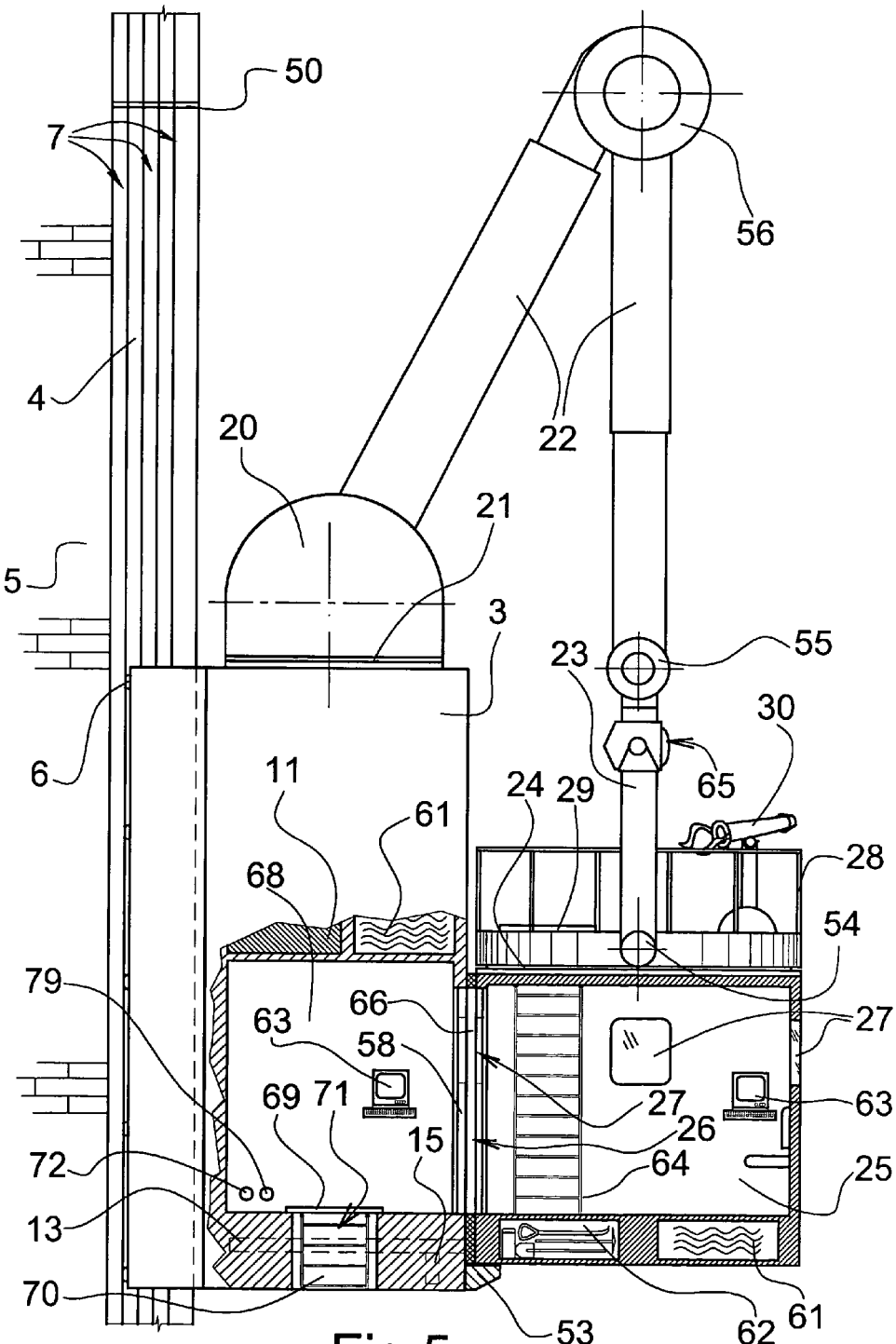
FIG. 5 shows a side view of the elevator portion being connected with the cabin.

Variant A—Passenger compartment 68 of the elevator portion 3, which is put into action when the cabin 25 is full and the autonomous rescue elevator 60 hasn't returned to the elevator portion 3—to pick up a new group of evacuated people; in such case, the cabin 25 with the evacuated people is transported and aligned to the passenger compartment 68 of the elevator portion 3—as it is shown in FIG. 5.

Close and safe fitting (alignment) of the cabin 25 to the surface of the passenger compartment 68 of the elevator portion 3 is fulfilled with the help of an elastic profile element 66 installed along the outer perimeter of the sliding doors 26 of the cabin 25, and also, with the help of supporting elements with elastic gaskets 53 of the elevator portion 3.

Then, the sliding doors 26 of the cabin 25 and the sliding doors 58 of the passenger compartment 68 of the elevator portion 3 are opened, people leave the cabin 25 for the passenger compartment 68. All these doors are then closed, the cabin 25 disconnects from the passenger compartment 68 and returns to the dangerous level of the building 5—to pick up a new group of evacuated people.

By that time, the autonomous rescue elevator 60 has already traveled from the auxiliary part of the building 49 (where it unloaded the evacuated people) to the elevator portion 3 and aligned with it.

After this alignment is completed, a hatch 69 of the passenger compartment 68, and a hatch 73 of the autonomous rescue elevator 60 are opened, and people go down from the passenger compartment 68 to the autonomous rescue elevator 60—through the vertical embrasure 70 on the staircase 71.

As the capacity of the autonomous rescue elevator 60 is several times more than of the cabin 25, it is possible, at the same time, to align the cabin 25 with the autonomous rescue elevator 60 and to make a transfer of another group of evacuated people from the cabin 25 to the rescue elevator 60.

As a consequence of the above-described actions, the cabin 25 will be always in work, without waste of time, helping to timely evacuation of people from the dangerous level.

Variant B—Emergency exits 57 of the building will be put into action when some part of the building located below the dangerous level may be used for evacuation of people—if the staircases there are not under fire or smoke, and if they are not destroyed. In such case, the autonomous rescue elevator 60 doesn't have to go down to the lowest level of the building 5—to the auxiliary part (especially if it is a high-rise building).

In such cases, to save time, the autonomous rescue elevator 60 with a group of evacuated people is lowered to a safe level of the building.

There, the rescue elevator 60 will stop, and the sliding doors 76 of the elevator 60 will be aligned with the evacuation exit 57 of this floor (level).

The sliding doors 76 of the autonomous rescue elevator 60 and the door of an emergency exit 57 of the building are opened, and the people leave the rescue elevator 60—to enter inside the building. Now, inside the building this group of evacuated people walk down on the interior emergency staircases, and the autonomous rescue elevator 60 goes up—to pick up a new group of evacuated people.

The elevator portion 3 and the whole attachable structure (with the telescopic arm 22 and the cabin 25), as well as the autonomous rescue elevator 60 can be controlled by personnel—both from inside, with the help of control panels 63, and from outside —with the help of remote controls 48.

The elevator portion 3 and the whole attachable structure (with the telescopic arm 22 and with the cabin 25) and the autonomous rescue elevator 60 have a hermetic thermo-insulating outer coating.

The elevator portion 3 and the whole attachable structure (with the telescopic arm 22 and with the cabin 25) and the autonomous rescue elevator 60 are provided with telemetric equipment (temperature, distance control and pollution sensors, camcorders, long distance lighting—searchlight projector 65, etc., speakers and radio).

The elevator portion 3, cabin 25 and the autonomous rescue elevator 60 have compartments 62 for auxiliary equipment, compartments 61—for keeping fire-fighting materials—foam, water and oxygen, and also, terminals 72 and supplying hoses 74.

The elevator portion 3, cabin 25 and the autonomous rescue elevator 60 are supplied with batteries and terminals 79—for charging them.

The ensure safe and effective work of fire-fighting personnel on any level, the cabin 25 is provided with an outside surface 28 with a barrier, fire-pump 30, hatch 29 and a staircase 64. The elevator portion 3, cabin 25 and the autonomous rescue elevator 60 are equipped with hermetically closed sliding doors (accordingly, 58, 26, 59 and 76) and with fireproof glass windows 27.

The passenger compartment 68 of the elevator portion 3, cabin 25 and the autonomous rescue elevator 60 are provide with cleaning and air-conditioning systems, and with oxygen masks and set of medicines for emergency medical help.

The H-shaped rail may be supplied with illumination means—to ensure visual control of the whole line during nighttime.

To avoid overheating of the H-shaped rail during the fire (and, accordingly, possible deformation), thermo-insulating sections 50 (made, e.g. of asbestos materials) are mounted on the rail surface (at equal distances, and without affecting its contour).

To ensure safety, the spring shock-absorbers 38 are mounted on the upper part of the tray 42 of the attachable section 31 of the H-shaped rail.

To increase exploiting abilities, the H-shaped rail 4 is mounted in the vertical embrasure 77 which is located in the outer surface of the building 5. The deepness of the embrasure 77 is such that the outer surface of the H-shaped rail 4 doesn't extend over the outer limits of the building 5.

What is claimed is:

1. A sliding frame for a functional compartment comprising, a functional compartment in a building, a sliding frame mounted in the functional compartment, a jack attached to the building and to the sliding frame for moving the sliding frame from inside the functional compartment to beyond the outer limits of the building and back, at least two guiders in the surface of the functional compartment, a plurality of support wheels attached to the sliding frame and running in the guiders for smooth and safe sliding of the frame in the functional compartment, a receiving panel in the front part of the sliding frame, with pocket guiders on the right and left sides of the receiving panel a section of an elevator rail attached to a mounting panel, the mounting panel connected to the receiving panel.

2. A sliding frame for a functional compartment as in claim 1 having, the receiving panel with beveled guiding sides.

3. A sliding frame for a functional compartment as in claim 2 having, a concrete base under the functional compartment for safe mounting—demounting of the attachable section of the rail.

* * * * *